US012016503B2

(12) United States Patent
Miller

(10) Patent No.: US 12,016,503 B2
(45) Date of Patent: Jun. 25, 2024

(54) EXTRACTION CLEANER WITH QUICK EMPTY TANK

(71) Applicant: BISSELL Inc., Grand Rapids, MI (US)

(72) Inventor: David M. Miller, Zeeland, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/228,976

(22) Filed: Aug. 1, 2023

(65) Prior Publication Data

US 2023/0371774 A1 Nov. 23, 2023

Related U.S. Application Data

(63) Continuation of application No. 17/089,299, filed on Nov. 4, 2020, now Pat. No. 11,737,633, which is a continuation of application No. 16/225,120, filed on Dec. 19, 2018, now Pat. No. 10,827,902, which is a continuation of application No. 15/840,245, filed on Dec. 13, 2017, now Pat. No. 10,188,253.

(60) Provisional application No. 62/436,684, filed on Dec. 20, 2016.

(51) Int. Cl.

| | |
|---|---|
| ***A47L 11/40*** | (2006.01) |
| ***A47L 7/00*** | (2006.01) |
| ***A47L 11/34*** | (2006.01) |

(52) U.S. Cl.

CPC ..... *A47L 11/4025* (2013.01); *A47L 7/0038* (2013.01); *A47L 11/34* (2013.01); *A47L 11/4016* (2013.01); *A47L 2601/03* (2013.01)

(58) Field of Classification Search

CPC .... A47L 11/4025; A47L 7/0038; A47L 11/34; A47L 11/4016; A47L 2601/03

See application file for complete search history.

(56) References Cited

U.S. PATENT DOCUMENTS

| | | | | |
|---|---|---|---|---|
| 2,248,699 A * | 7/1941 | Finnell | A47L 11/283 | 222/274 |
| 3,055,039 A * | 9/1962 | Smith | A47L 7/0042 | 15/353 |
| 5,715,568 A * | 2/1998 | Berfield | F04D 29/606 | 15/353 |
| 6,438,793 B1 * | 8/2002 | Miner | C11D 3/0031 | 15/391 |

(Continued)

FOREIGN PATENT DOCUMENTS

| | | |
|---|---|---|
| CN | 1768692 A | 5/2006 |
| CN | 101254080 A | 9/2008 |

(Continued)

OTHER PUBLICATIONS

A Eckenschwiller, Extending European Search Report, dated May 23, 2018, 5 pages, Munic Germany.

(Continued)

*Primary Examiner* — Marc Carlson

(74) *Attorney, Agent, or Firm* — Price Heneveld LLP

(57) ABSTRACT

An extraction cleaner is provided with a removable recovery tank having a recovery container, a drain opening quick-empty valve, and an actuator assembly for emptying the recovery container. The drain opening can be provided on a lower portion of the recovery container. The actuator assembly can selectively open the valve. At least a portion of the actuator assembly can be provided on an upper portion of the recovery container.

20 Claims, 11 Drawing Sheets

(56) References Cited

U.S. PATENT DOCUMENTS 6,513,189 B1 * 2/2003 Berry ..... A47L 7/0042 15/353
6,513,793 B2 * 2/2003 Bellon ..... A01K 3/005 119/908
6,912,757 B2 * 7/2005 Kaufman ..... A47L 7/0042 15/353
6,991,666 B2 * 1/2006 Organ ..... A47L 9/1625
7,814,926 B2 * 10/2010 Hoffmeier ..... E03F 5/22 604/320
2001/0000830 A1 * 5/2001 Kasper ..... H05B 3/00 15/352
2004/0111825 A1 * 6/2004 Kaufman ..... A47L 7/0042 15/353
2008/0086991 A1 * 4/2008 Hale ..... A47L 7/0042 55/378
2009/0265882 A1 * 10/2009 Rhea ..... A47L 7/0042 55/357
2010/0139032 A1 * 6/2010 Tomasiak ..... A47L 7/0042 29/402.01
2011/0107528 A1 * 5/2011 Haan ..... A47L 11/33 15/4
2012/0066861 A1 * 3/2012 Louis ..... A47L 11/34 15/347
2012/0222235 A1 * 9/2012 Lenkiewicz ..... A47L 11/4002 15/322
2012/0228785 A1 * 9/2012 Park ..... A47L 11/4025 261/38
2013/0009371 A1 * 1/2013 Martinez ..... A47L 7/0038 280/79.2
2014/0373306 A1 * 12/2014 Tomasiak ..... A47L 9/127 29/402.04
2015/0067978 A1 * 3/2015 Westbrook ..... A47L 7/0038 137/1
2016/0270620 A1 * 9/2016 Miller ..... A47L 9/02
2017/0071434 A1 * 3/2017 Nguyen ..... A47L 11/4027
2017/0280954 A1 * 10/2017 Romero ..... A47L 5/18
2018/0168416 A1 * 6/2018 Miller ..... A47L 11/34
2019/0117033 A1 * 4/2019 Miller ..... A47L 11/4016

FOREIGN PATENT DOCUMENTS

CN 201123781 Y 10/2008
CN 101320275 A 12/2008
CN 102341691 A 2/2012
CN 103188981 A 7/2013
CN 205514395 U 8/2016
DE 202016104991 U1 12/2016
EP 2848174 A2 3/2015
EP 3142536 B1 * 11/2021 ..... A47L 11/30
FR 2830181 A1 4/2003
JP H07275820 A 10/1995

OTHER PUBLICATIONS

Chinese Office Action corresponding to Chinese Application No. 201711324739.8 dated Apr. 4, 2019.
Second Chinese Office Action corresponding to Chinese Application No. 201711324739.8 dated Jul. 29, 2019.

* cited by examiner

EXTRACTION CLEANER WITH QUICK EMPTY TANK

CROSS-REFERENCE TO RELATED APPLICATIONS

This application is a continuation of U.S. patent application Ser. No. 17/089,299, filed Nov. 4, 2020, now U.S. Pat. No. 11,737,633, issued Aug. 29, 2023, which is a continuation of U.S. patent application Ser. No. 16/225,120, filed Dec. 19, 2018, now U.S. Pat. No. 10,827,902, issued Nov. 10, 2020, which is a continuation of U.S. patent application Ser. No. 15/840,245, filed Dec. 13, 2017, now U.S. Pat. No. 10,188,253, issued Jan. 29, 2019, which claims the benefit of U.S. Provisional Patent Application No. 62/436,684, filed Dec. 20, 2016, all of which are incorporated herein by reference in their entirety.

BACKGROUND

Extraction cleaners are well-known surface cleaning apparatuses for deep cleaning carpets and other fabric surfaces, such as upholstery. Most extraction cleaners or extractors comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. The recovery tank is often removably mounted on the extraction cleaner in order to remove the recovery tank for emptying.

BRIEF DESCRIPTION

According to one aspect of the present disclosure, an extraction cleaner includes a housing, a suction nozzle provided on the housing, a suction source provided on the housing and in fluid communication with the suction nozzle for generating a working airstream, and a recovery tank assembly adapted for separating and collecting fluid and debris from the working airstream for later disposal, wherein the recovery tank assembly is removably mounted on the housing and comprises a recovery container having an upper portion and a lower portion, the recovery container defining at least a portion of a recovery chamber, a drain opening provided with the lower portion, a valve fluidly connected to the drain opening for movement between a closed position wherein the valve seals the recovery chamber and an opened position wherein the valve allows for draining fluid from the recovery chamber, and an actuator operably coupled to the valve and adapted for moving the valve, wherein at least a portion of the actuator is provided on an upper portion of the recovery container.

According to another aspect of the present disclosure, an extraction cleaner includes a housing, a suction nozzle provided on the housing, a suction source provided within the housing and in fluid communication with the suction nozzle for generating a working airstream, and a recovery tank assembly adapted for separating and collecting fluid and debris from the working airstream for later disposal, the recovery tank assembly comprising a recovery container defining a recovery chamber and comprising a drain opening provided within a lower portion of the recovery container, a drain plug selectively fluidly connected to the drain opening, and an actuator for selectively moving the drain plug between a closed position and an opened position wherein a portion of the actuator is engageable by a user and the portion is remotely located from the drain plug.

BRIEF DESCRIPTION OF THE DRAWINGS

The present disclosure will now be described with respect to the drawings in which.

DETAILED DESCRIPTION

The present disclosure relates to extraction cleaners. In one of its aspects, the present disclosure relates to an extraction cleaner with a removable recovery tank and an improved arrangement for emptying the recovery tank.

Figure 1:
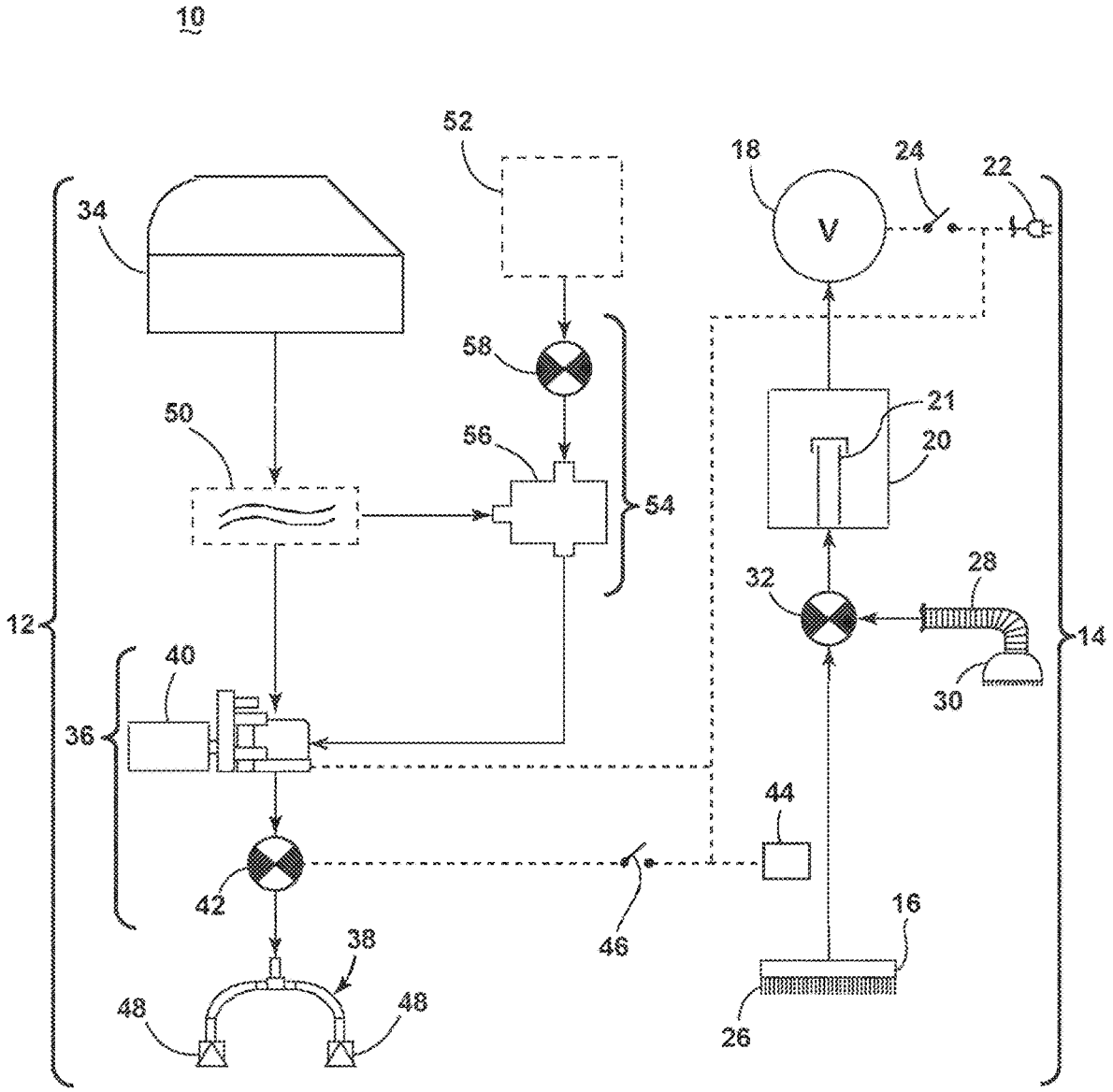
FIG. 1 is a schematic view of a surface cleaning apparatus in the form of an extraction cleaner.

FIG. 1 is a schematic view of various functional systems of a surface cleaning apparatus in the form of an extraction cleaner 10. The functional systems of the extraction cleaner 10 can be arranged into any desired configuration, such as an upright extraction device having a base and an upright body for directing the base across the surface to be cleaned, a canister device having a cleaning implement connected to a wheeled base by a vacuum hose, a portable extractor adapted to be hand carried by a user for cleaning relatively small areas, an autonomous extraction cleaner, or a commercial extractor. Any of the aforementioned extraction cleaners can be adapted to include a flexible vacuum hose, which can form a portion of the working air conduit between a nozzle and the suction source.

The extraction cleaner 10 can include a fluid delivery system 12 for storing cleaning fluid and delivering the cleaning fluid to the surface to be cleaned and a recovery system 14 for removing the spent cleaning fluid and debris from the surface to be cleaned and storing the spent cleaning fluid and debris.

The recovery system 14 can include a suction nozzle 16, a suction source 18 in fluid communication with the suction nozzle 16 for generating a working airstream, and a recovery tank 20 for separating and collecting fluid and debris from the working airstream for later disposal. A separator 21 can be formed in a portion of the recovery tank 20 for separating fluid and entrained debris from the working airstream.

The suction source 18, such as a motor/fan assembly, is provided in fluid communication with the recovery tank 20. The motor/fan assembly 18 can be electrically coupled to a power source 22, such as a battery or by a power cord plugged into a household electrical outlet. A suction power switch 24 between the motor/fan assembly 18 and the power source 22 can be selectively closed by the user, thereby activating the motor/fan assembly 18.

The suction nozzle 16 can be provided on a base or cleaning head adapted to move over the surface to be cleaned. An agitator 26 can be provided adjacent to the suction nozzle 16 for agitating the surface to be cleaned so that the debris is more easily ingested into the suction nozzle 16. Some examples of agitators include, but are not limited to, a horizontally-rotating brushroll, dual horizontally-rotating brushrolls, one or more vertically-rotating brushrolls, or a stationary brush.

The extraction cleaner 10 can also be provided with above-the-floor cleaning features. A vacuum hose 28 can be selectively fluidly coupled to the motor/fan assembly 18 for above-the-floor cleaning using an above-the floor cleaning tool 30 with its own suction inlet. A diverter assembly 32 can be selectively switched between on-the-floor and above-the floor cleaning by diverting fluid communication between either the suction nozzle 16 or the vacuum hose 28 with the motor/fan assembly 18.

The fluid delivery system 12 can include at least one fluid container 34 for storing a supply of fluid. The fluid can include one or more of any suitable cleaning fluids, including, but not limited to, water, compositions, concentrated detergent, diluted detergent, etc., and mixtures thereof. For example, the fluid can include a mixture of water and concentrated detergent.

The fluid delivery system 12 can further include a flow control system 36 for controlling the flow of fluid from the container 34 to at least one fluid distributor 38. In one configuration, the flow control system 36 can include a pump 40 which pressurizes the system 12 and a flow control valve 42 which controls the delivery of fluid to the distributor 38. An actuator 44 can be provided to actuate the flow control system 36 and dispense fluid to the distributor 38. The actuator 44 can be operably coupled to the valve 42 such that pressing the actuator 44 will open the valve 42. The valve 42 can be electrically actuated, such as by providing an electrical switch 46 between the valve 42 and the power source 22 that is selectively closed when the actuator 44 is pressed, thereby powering the valve 42 to move to an open position. In one example, the valve 42 can be a solenoid valve. The pump 40 can also be coupled with the power source 22. In one example, the pump 40 can be a centrifugal pump. In another example, the pump 40 can be a solenoid pump.

The fluid distributor 38 can include at least one distributor outlet 48 for delivering fluid to the surface to be cleaned. The at least one distributor outlet 48 can be positioned to deliver fluid directly to the surface to be cleaned, or indirectly by delivering fluid onto the agitator 26 The at least one distributor outlet 48 can include any structure, such as a nozzle or spray tip; multiple outlets 48 can also be provided. As illustrated in FIG. 1, the distributor 38 can include multiple sprayers 48 which distribute cleaning fluid to the surface to be cleaned. For above-the-floor cleaning, the cleaning tool 30 can include an auxiliary distributor (not shown) coupled with the fluid delivery system 12.

Optionally, a heater 50 can be provided for heating the cleaning fluid prior to delivering the cleaning fluid to the surface to be cleaned. In the example illustrated in FIG. 1, an in-line heater 50 can be located downstream of the container 34 and upstream of the pump 40. Other types of heaters 50 can also be used. In yet another example, the cleaning fluid can be heated using exhaust air from a motor-cooling pathway for the motor/fan assembly 18.

As another option, can be provided with an additional container 52 for storing a fluid. For example, the first container 34 can sore water and the second container 52 can store a cleaning agent such as detergent. The containers 34, 52 can, for example, be defined by a supply tank and/or a collapsible bladder. In one configuration, the first container 34 can be a bladder that is provided within the recovery tank 20. Alternatively, a single container can define multiple chambers for different fluids.

In the case where multiple containers 34, 52 are provided, the flow control system 36 can further be provided with a mixing system 54 for controlling the composition of the cleaning fluid that is delivered to the surface. The composition of the cleaning fluid can be determined by the ratio of cleaning fluids mixed together by the mixing system. As shown herein, the mixing system 54 includes a mixing manifold 56 that selectively receives fluid from one or both of the containers 34, 52. A mixing valve 58 is fluidly coupled with an outlet of the second container 52, whereby when mixing valve 58 is open, the second cleaning fluid will flow to the mixing manifold 56. By controlling the orifice of the mixing valve 58 or the time that the mixing valve 58 is open, the composition of the cleaning fluid that is delivered to the surface can be selected.

In yet another configuration of the fluid delivery system 12, the pump 40 can be eliminated and the flow control system 36 can include a gravity-feed system having a valve fluidly coupled with an outlet of the container(s) 34, 52, whereby when valve is open, fluid will flow under the force of gravity to the distributor 38. The valve can be mechanically actuated or electrically actuated, as described above.

The extraction cleaner 10 shown in FIG. 1 can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

In operation, the extraction cleaner 10 is prepared for use by coupling the extraction cleaner 10 to the power source 22, and by filling the first container 34, and optionally the second container 52, with cleaning fluid. Cleaning fluid is selectively delivered to the surface to be cleaned via the fluid delivery system 12 by user-activation of the actuator 44, while the extraction cleaner 10 is moved back and forth over the surface. The agitator 26 can simultaneously agitate the cleaning fluid into the surface to be cleaned. During operation of the recovery system 14, the extraction cleaner 10 draws in fluid and debris-laden working air through the suction nozzle 16 or cleaning tool 30, depending on the position of the diverter assembly 32, and into the downstream recovery tank 20 where the fluid debris is substantially separated from the working air. The airstream then passes through the motor/fan assembly 18 prior to being exhausted from the extraction cleaner 10. The recovery tank 20 can be periodically emptied of collected fluid and debris.

Figure 2:
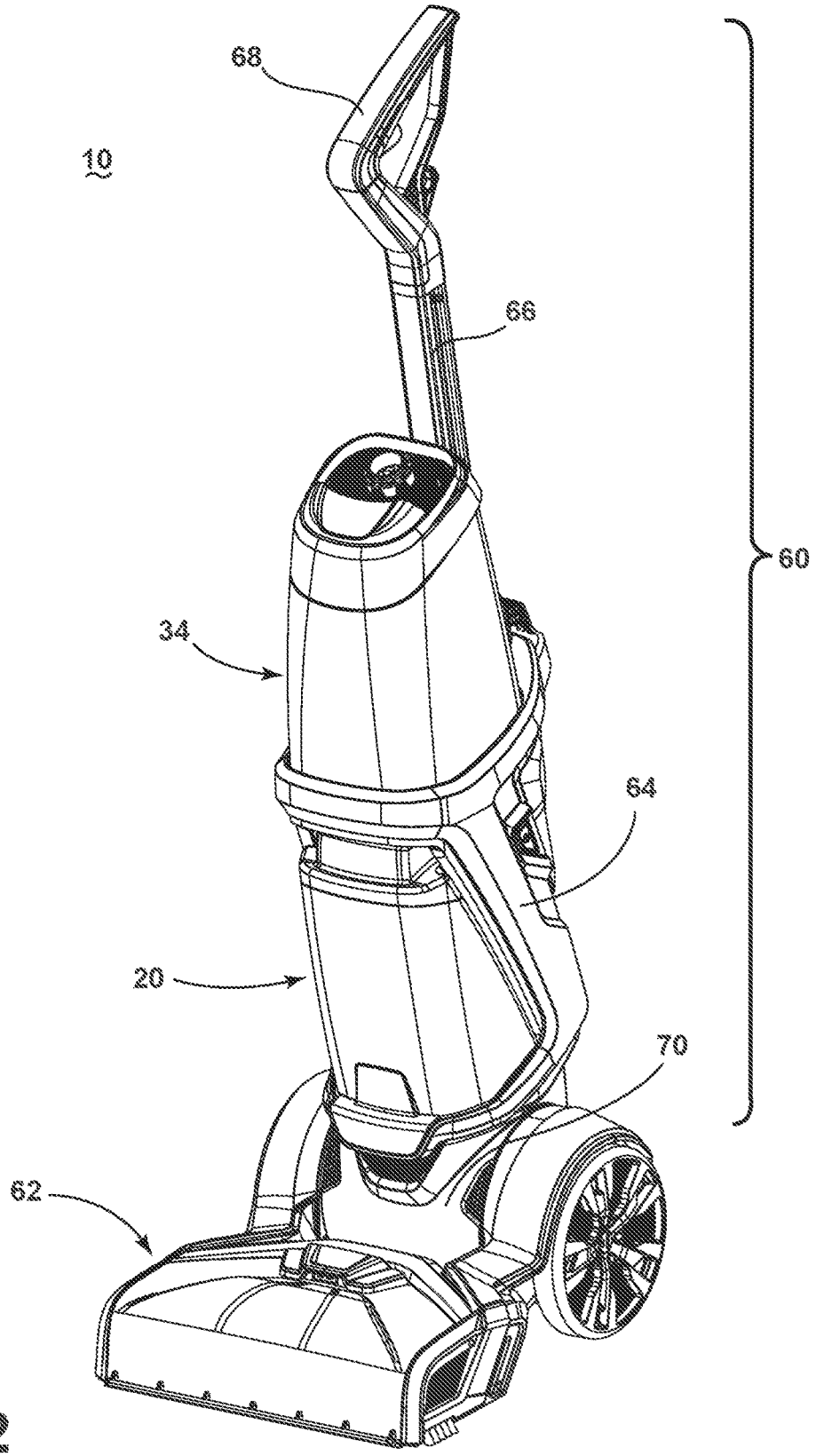
FIG. 2 is a front perspective view of an extraction cleaner according to one aspect of the present disclosure.

FIG. 2 is a perspective view illustrating one non-limiting example of an extraction cleaner 10, according to a first aspect of the present disclosure. As illustrated herein, the extraction cleaner 10 is an upright extraction cleaner having a housing that includes an upright assembly 60 that is pivotally connected to a base assembly 62 for directing the base assembly 62 across the surface to be cleaned. The extraction cleaner 10 can include the various systems and components schematically described for FIG. 1, including the fluid delivery system 12 for storing and delivering a cleaning fluid to the surface to be cleaned and the recovery system 14 for extracting and storing the dispensed cleaning fluid, dirt and debris from the surface to be cleaned. The various systems and components schematically described for FIG. 1, including the fluid delivery system 12 and fluid recovery system 14 can be supported by either or both the base assembly 62 and the upright assembly 60.

For purposes of description related to the figures, the terms "upper," "lower," "right," "left," "rear," "front," "vertical," "horizontal," "inner," "outer," and derivatives thereof shall relate to the present disclosure as oriented in FIG. 2 from the perspective of a user behind the extraction cleaner 10, which defines the rear of the extraction cleaner 10. However, it is to be understood that the present disclosure may assume various alternative orientations, except where expressly specified to the contrary.

The upright assembly 60 includes a main support section or frame 64 supporting components of the fluid delivery system 12 and the recovery system 14, including, but not limited to, the recovery tank 20 and the fluid container 34. The upright assembly 60 also has an elongated handle 66 extending upwardly from the frame 64 that is provided with a hand grip 68 at one end that can be used for maneuvering the extraction cleaner 10 over a surface to be cleaned. The frame 64 of the upright assembly 60 can include container receivers for respectively receiving the recovery tank 20 and fluid container 34 for support on the upright assembly 60; additional details of suitable container receivers are disclosed in U.S. Pat. No. 10,188,252, filed Sep. 13, 2016 and published Mar. 16, 2017, which is incorporated herein by reference in its entirety. A motor housing 70 is formed at a lower end of the frame 64 and contains the motor/fan assembly 18 (FIG. 1) positioned therein in fluid communication with the recovery tank 20. Additional details of a suitable base assembly 62 for the extraction cleaner 10 is disclosed in U.S. Pat. No. 10,188,252, incorporated above.

Figure 4:
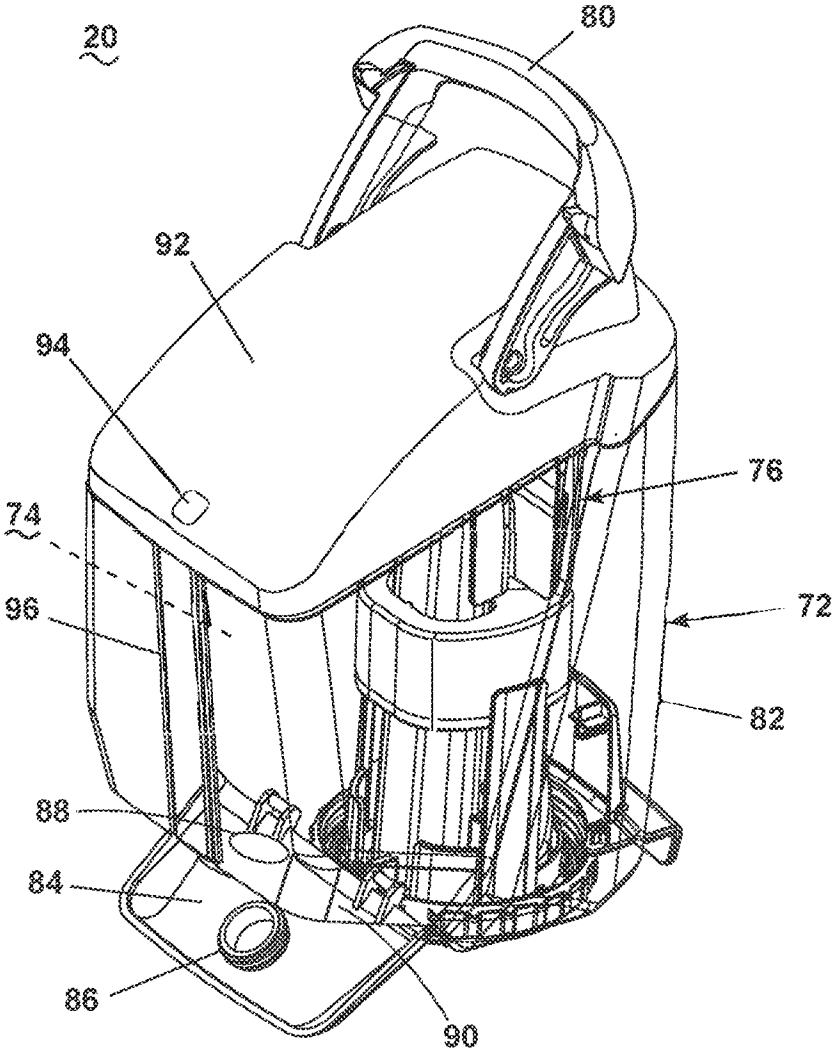
FIG. 4 is a view similar to FIG. 3, showing a bottom empty door of the recovery tank in an open position.
Figure 3:
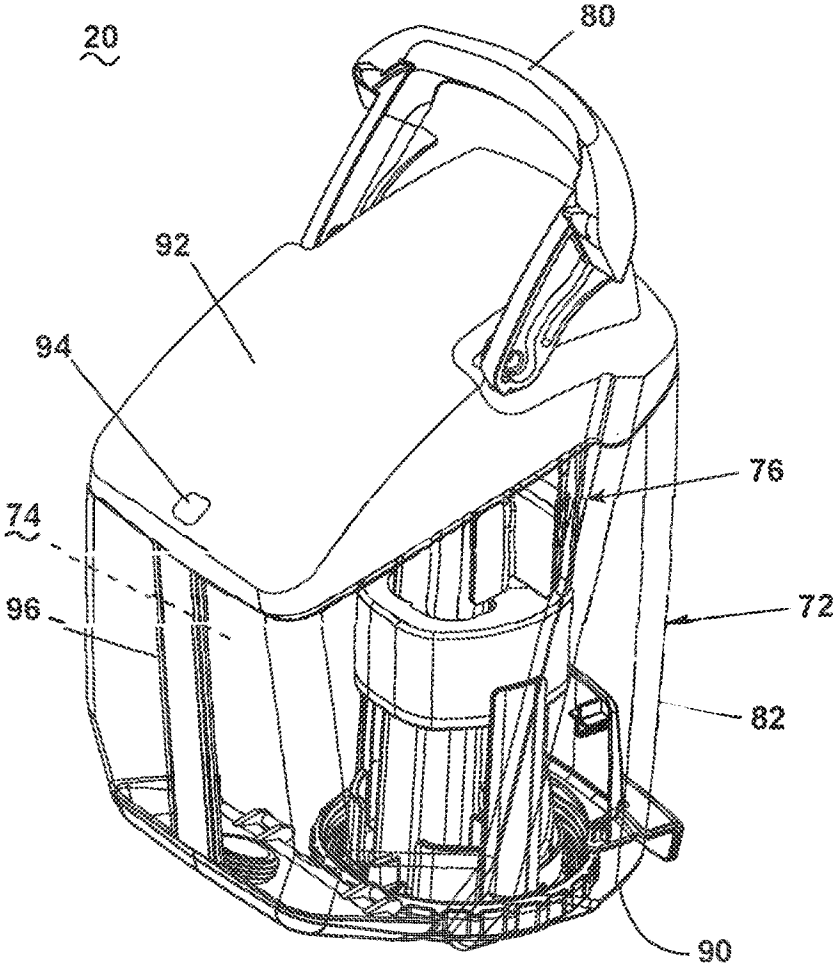
FIG. 3 is a perspective view of a recovery tank for an extraction cleaner according to a first aspect of the present disclosure.

FIG. 3 is a perspective view of a recovery tank 20 for an extraction cleaner according to a first aspect of the present disclosure and FIG. 4 is a partially exploded, side view of the recovery tank 20. The recovery tank 20 may be used on the extraction cleaner 10 shown in FIG. 1 or FIG. 2. The recovery tank 20 can include a recovery container 72 defining a recovery chamber 74 and an air/liquid separator 76 within the recovery chamber 74. At least a portion of the container 72 can be formed of a transparent or tinted translucent material, which permits a user to view the contents of the recovery tank 20. A badge 78 can be provided on a front lower portion of the container 72. A handle 80 can be provided on the container 72, which facilitates removing and carrying the container 72. The handle 80 can be pivotally coupled to the container 72 and can be provided near the top of the container 72, although other locations are possible.

The recovery container 72 can generally have a bottom end and a top end opposite the bottom end. Particularly as shown herein, the recovery container 72 can include a bottom wall 90 and a top wall 92, with a peripheral side wall 82 extending between the bottom wall 90 and the top wall 92. The air/liquid separator 76 can be located within the recovery container 72, with the space between the separator 76 and the side and bottom walls 82, 90 forming the recovery chamber 74 for holding recovered debris and fluid. The carry handle 80 is provided at the top wall 92 of the container, and can be pivotally mounted to the side walls 82. In an alternate aspect, not shown, the top wall 92 of the container 72 may form or be defined by a removable tank lid for the recovery tank 20, with the tank lid 92 carrying the handle 80.

The container 72 can be provided with a drain opening 88 for emptying the container 72. A valve is fluidly connected to the drain opening 88 for movement between a closed position for sealing the recovery chamber 74 and an open position for draining fluid from the recovery chamber 74 through the drain opening 88. An actuator, at least a portion of which may be manually-engageable by a user, is provided for selectively opening the valve. In one aspect, at least a portion of the actuator may conveniently be provided on an upper portion of the container 72. As such, the valve may be remotely-actuated.

The container 72 can be provided with a drain opening 88 for emptying the container 72. A valve is fluidly connected to the drain opening 88 for movement between a closed position for sealing the recovery chamber 74 and an open position for draining fluid from the recovery chamber 74 through the drain opening 88. An actuator, at least a portion of which may be manually-engageable by a user, is provided for selectively opening the valve. In one aspect, at least a portion of the actuator may conveniently be provided on an upper portion of the container 72. As such, the valve may be remotely-actuated.

The drain plug 86 is aligned with the drain opening 88 to seal the drain opening 88 when the door 84 is closed for a fluid-tight closure, such that the container 72 is leak-free. The drain plug 86 can be at least partially received in the drain opening 88 to stop up or fill the drain opening 88. Other sealing arrangements are possible, including seals which are not received within the drain opening 88 itself, but which provide a fluid-tight and leak proof engagement between the drain opening 88 and the door 84.

The actuator for the valve of the illustrated aspect includes at least a user-engageable button 94 and an elongate push rod 96 configured to selectively open the bottom empty door 84. The button 94 is operably connected to the push rod 96, and can be provided at an upper portion of the container 72, such as on the top wall 92 of the container 72. In one example, the button 94 can be connected to the push rod by a fastener (not shown), such as a mechanical fastener, a screw, a detent, or bayonet style hook, for example. The button 94 and push rod 96 can be biased upwardly by a spring (not shown). The elongate push rod 96 can be configured to selectively release a door latch 98 to open the bottom empty door 84 and separate the drain plug 86 from the drain opening 88. The door latch 98 can be any suitable device for holding the door 84 closed, and which may be released by the push rod 96.

Figure 10C:
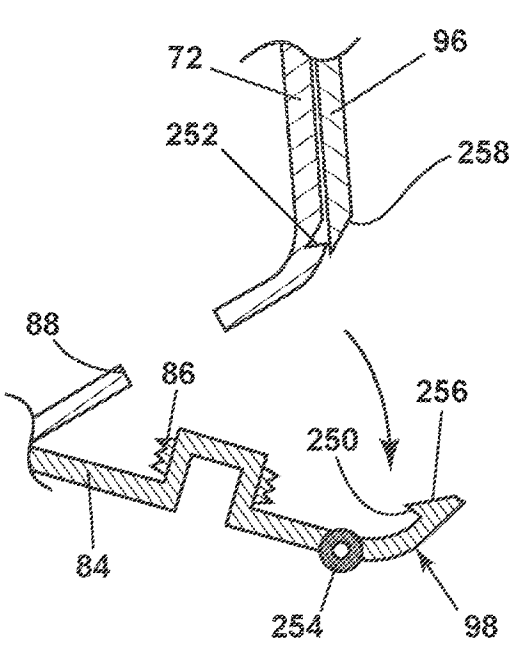
FIG. 10C is a partial cross-section schematic view of a latch of the recovery tank of FIG. 3 with the latch in a released position.
Figure 10B:
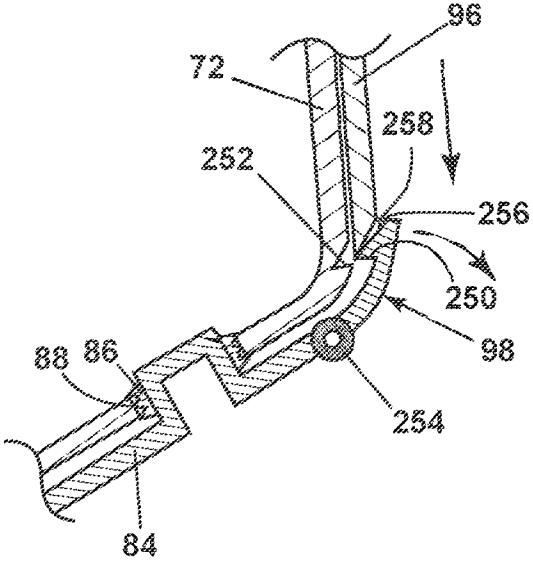
FIG. 10B is a partial cross-section schematic view of a latch of the recovery tank of FIG. 3 with the latch in a partially released position.
Figure 10A:
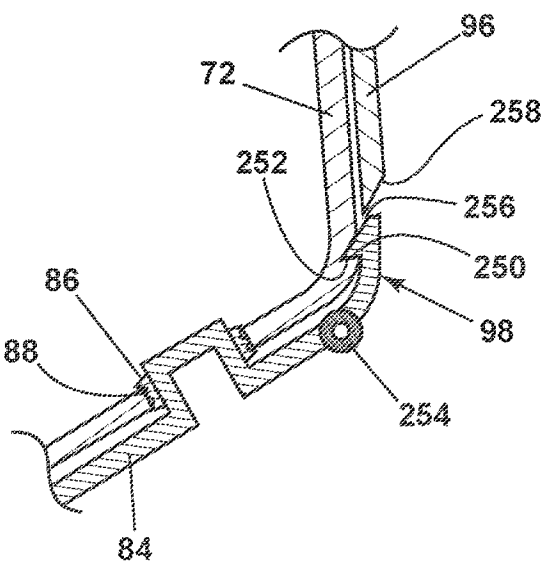
FIG. 10A is a partial cross-section schematic view of a latch of the recovery tank of FIG. 3 with the latch in a closed/locked position.

In one example illustrated in FIGS. 10A-10C, the door latch 98 can include a hook 250 for selectively engaging a catch 252 defined by a recess on the lower portion of the container 72. The door latch 98 is mounted to a forward portion of the bottom empty door 84 about a pivot 254, such that the hook 250 can be pivoted into our out of engagement with the catch 252. The latch 98 can be biased towards the locked position, i.e. with the hook 250 received by the catch 252, by a torsion spring (not shown). The hook 250 further includes a wedge-shaped cam surface 256 in operable engagement with a ramp 258 on a lower portion of the push rod 96. In operation, as the button 94 and push rod 96 are pressed downwardly, the cam surface 256 is configured to ride along the ramp 258, which forces the hook 250 to rotate outwardly and downwardly about the pivot 254, thereby disengaging the catch 252. The push rod 96 can continue to push the latch 98 downwardly, which releases the empty door 84 and separates the drain plug 86 from the drain opening 88 for emptying contents of the container 72.

The elongate push rod 96 can be provided on an exterior of the recovery tank 20; for example, the push rod 96 can be provided for sliding movement along the outside surface of the peripheral side wall 82. Pressing the button 94 translates the push rod 96 downwardly along the side wall 82 to push open the door 84.

Figure 5:
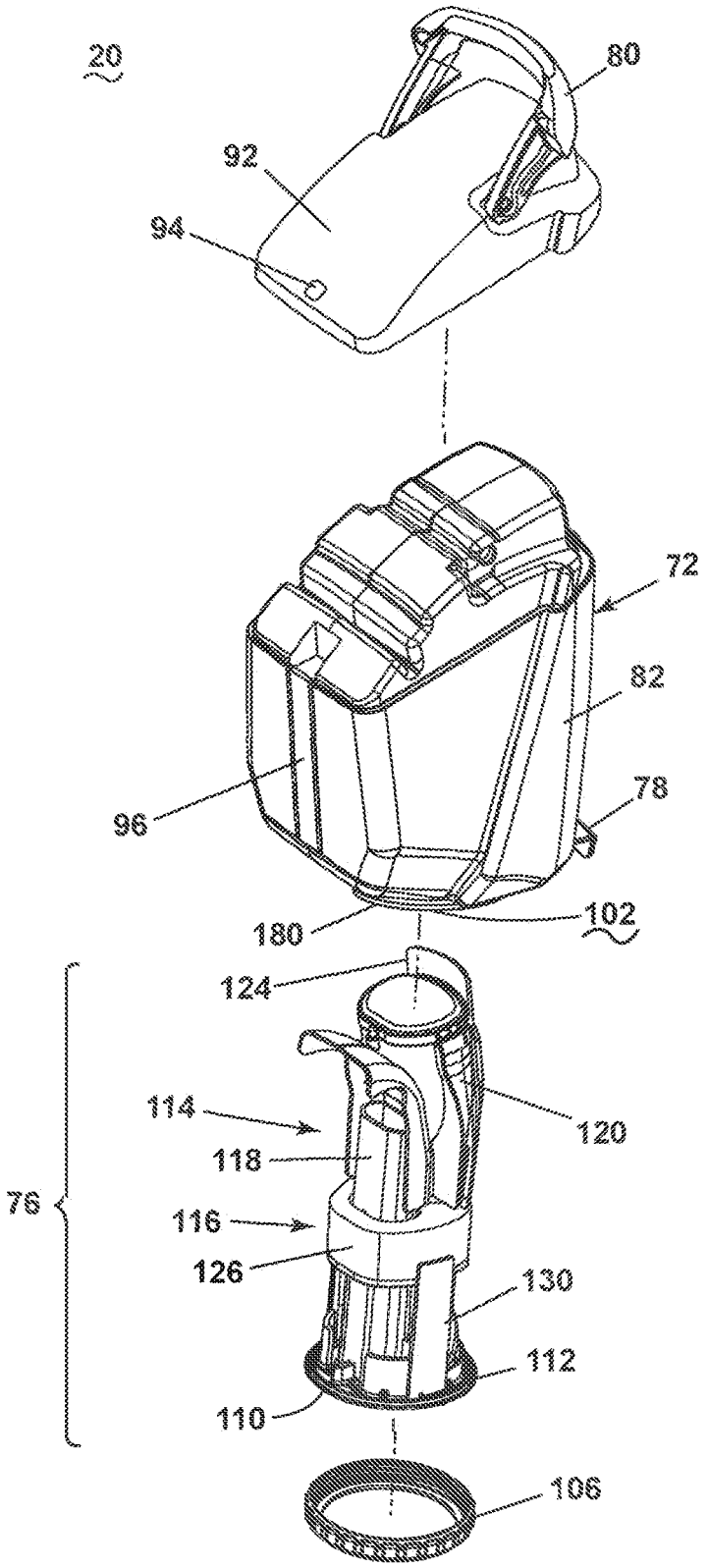
FIG. 5 is a partially exploded, side view of the recovery tank of FIG. 3.

FIG. 5 is a partially exploded, side view of the recovery tank 20 of FIG. 3. The container 72 has an insertion opening 102 through which the air/liquid separator 76 is inserted into and removed from the recovery chamber 74. The insertion opening 102 can be provided on the bottom wall 90 of the container 72, such that the air/liquid separator 76 is inserted through the opening 102 and extends upwardly from the bottom wall 90. The insertion opening 102 can be separate from the drain opening 88 for emptying the container 72 that is closed by the door 84, so that the air/liquid separator 76 does not have to be removed every time the container 72 is emptied. In the illustrated aspect the door 84 does not cover the insertion opening 102 so that the air/liquid separator 76 is removable from the container 72 without needing to open the door 84. Optionally as shown herein, the bottom wall 90 includes at least two surfaces provided on different planes and which may be angled relative to each other, with the drain opening 88 formed in one surface of the bottom wall 90 and the insertion opening 102 formed in another surface of the bottom wall 90.

The air/liquid separator 76 is configured to be easily removable from the recovery container 72 by a user. This permits the air/liquid separator 76 to be disassembled and cleaned more thoroughly as needed. A coupling between the recovery container 72 and the air/liquid separator 76 can be provided for facilitating easy separation of the two components. As shown herein, the coupling includes a threaded collar 106 which screws onto a threaded neck 180 on the bottom wall of the container 72 which defines the opening 102 through which the air/liquid separator 76 is inserted. A flange 110 on the bottom of the air/liquid separator 76 limits insertion of the separator 76 into the container 72. A seal 112 provides a fluid-tight interface between the container 72 and the and the air/liquid separator 76 when the air/liquid separator 76 is mounted within the recovery chamber 74, and also prevents the container 72 from leaking when removed from the upright assembly 60 (FIG. 2). Other couplings between the recovery container 72 and the air/liquid separator 76 can be provided, such as a bayonet-type coupling.

The air/liquid separator 76 includes a stack 114 for guiding air and liquid through the container 72 and a float assembly 116 for selectively closing the suction path through the container 72. The stack 114 includes an inlet column 118 which receives recovered air and liquid form the suction nozzle 16 (FIG. 1), and opens into the interior of the container 72, and an outlet column 120 which passes substantially clean air, and substantially no liquid, to the motor/fan assembly 18 (FIG. 1) and includes an air inlet port 122 at an upper end of the column 120.

The float assembly 116 includes float shutter 124 and a float body 126 coupled with the float shutter 124 for selectively raising the float shutter 124 to a closed position in which the float shutter 124 closes the air inlet port 122 of the outlet column 120. The float shutter 124 slides within a guide passage provided on the stack 114 defined by opposing guide projections 130 which receive the float body 126, with the float body 126 at least partially wrapping around the columns 118, 120. The float body 126 is buoyant, and as the liquid level container rises, the float body 126 raises the float shutter 124 to close the air inlet port 122 and prevent liquid from exiting the container 72 and entering the motor/fan assembly 18 (FIG. 1).

Figure 6:
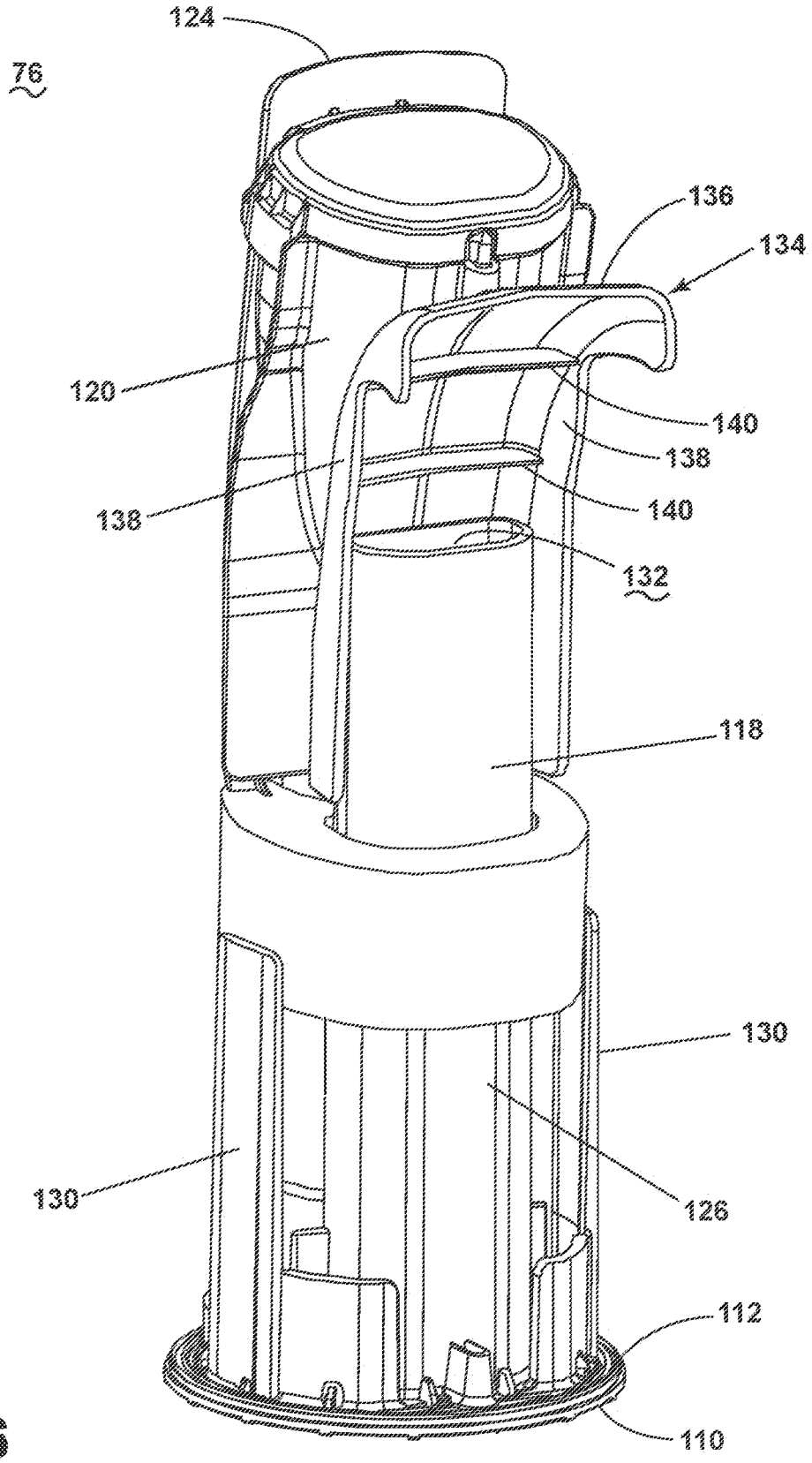
FIG. 6 is a rear perspective view of an air/liquid separator of the recovery tank of FIG. 3.

FIG. 6 is a rear perspective view of the air/liquid separator 76. The inlet column 118 includes an open upper end defining an air/liquid outlet port 132 that opens into the interior or recovery chamber 74 of the container 72. A separator shield 134 extends at least partially over or around the outlet port 132 to separate incoming air and liquid. The shield 134 may include a central portion 136 which curves outwardly and over the outlet port 132 and lateral side portions 138 which curve around the sides of the outlet port 132. At least one baffle 140 can also be provided to prevent the full volume of extracted liquid entering the container 72 from hitting the top of the shield 134 at high speed, thereby reducing the amount of foam and splashing inside the container 72. As illustrated, the at least one baffle 140 can include multiple ribs on the inner surface of the shield 134 and which project at least partially over the outlet port 132 to interrupt the liquid flow path and slow down the liquid. The ribs 140 can extend between the side portions 138 of the shield 134, partially or completely across the central portion 136.

Figure 7A:
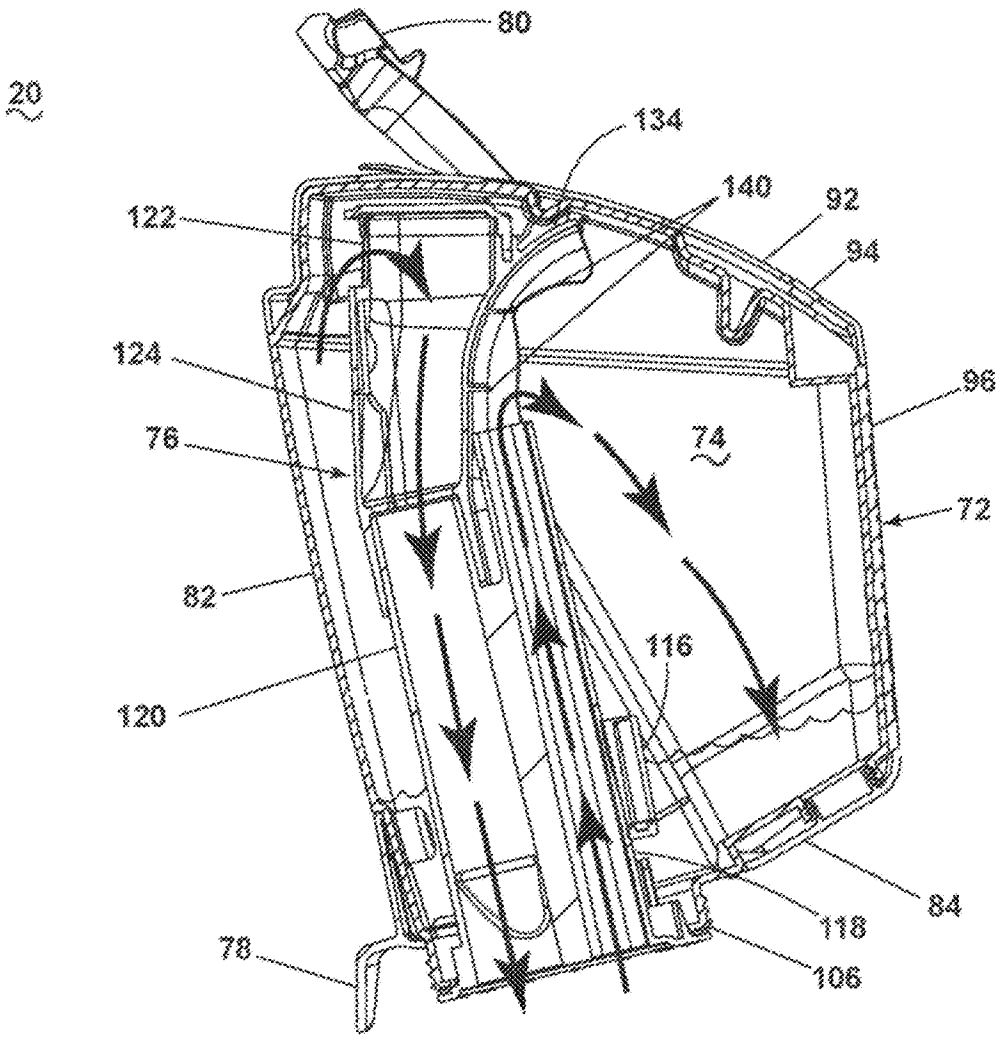
FIG. 7A is a cross-section view of the recovery tank of FIG. 3, showing the flow of air and liquid through the recovery tank, with a float assembly in an open position.
Figure 7B:
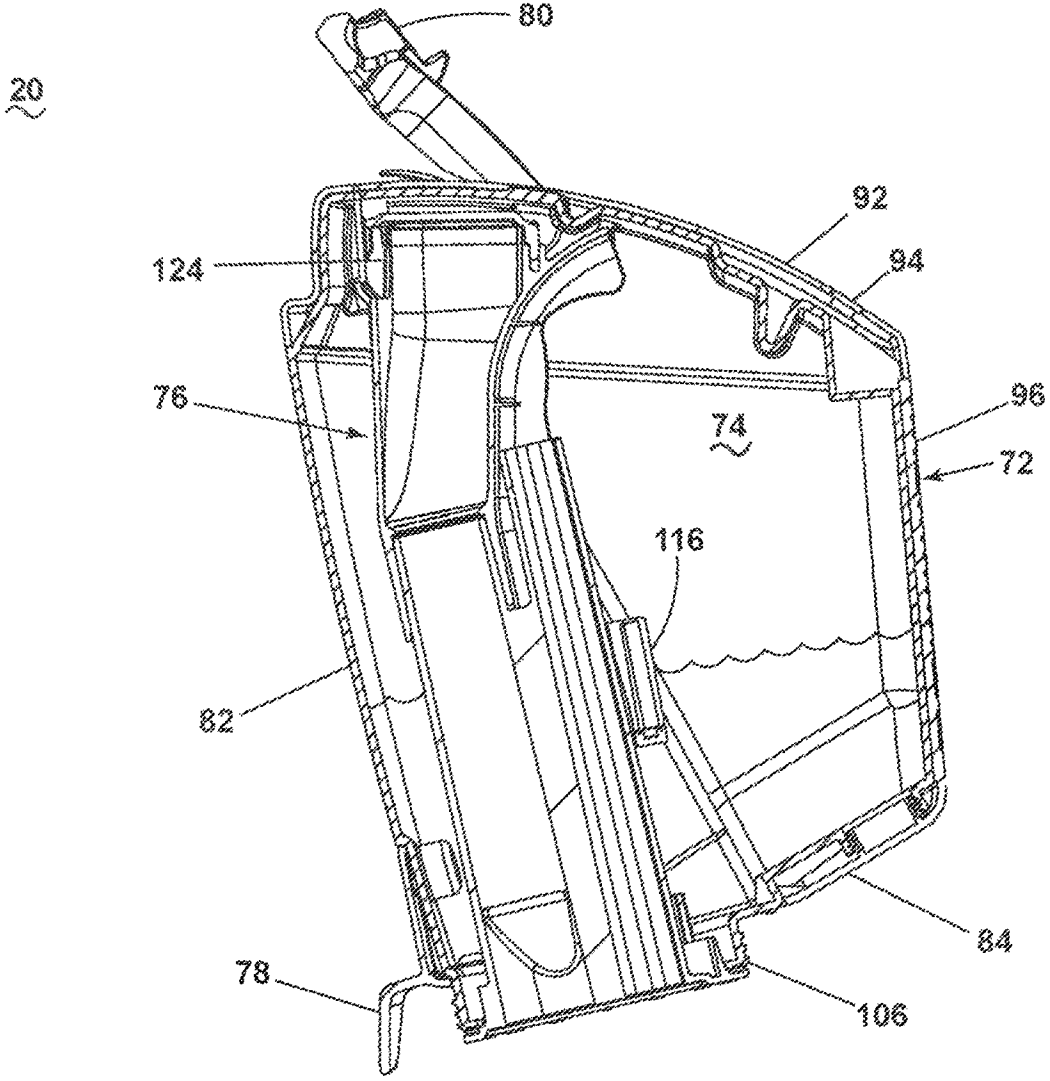
FIG. 7B is a view similar to FIG. 7A, showing the float assembly in a closed position.

FIGS. 7A-7B are cross-section views of the recovery tank 20. FIG. 7A shows the flow of air and liquid through the recovery tank 20 with arrows. Debris-containing fluid, which can contain air and liquid, is drawn into the container 72, via the inlet column 118 of the separator 76. The debris-containing fluid strikes the separator shield 134, but is first slowed by the ribs 140. Liquid and debris in the fluid then fall under the force of gravity to the bottom of the container 72. The air drawn into the container 72, now separated from liquid and debris, is drawn into the outlet column 120. As the level of liquid in the container 72 rises, the float assembly 116 will move from an open position, one example of which is shown in FIG. 7A, to a closed position, one example of which is shown in FIG. 7B.

Figure 8:
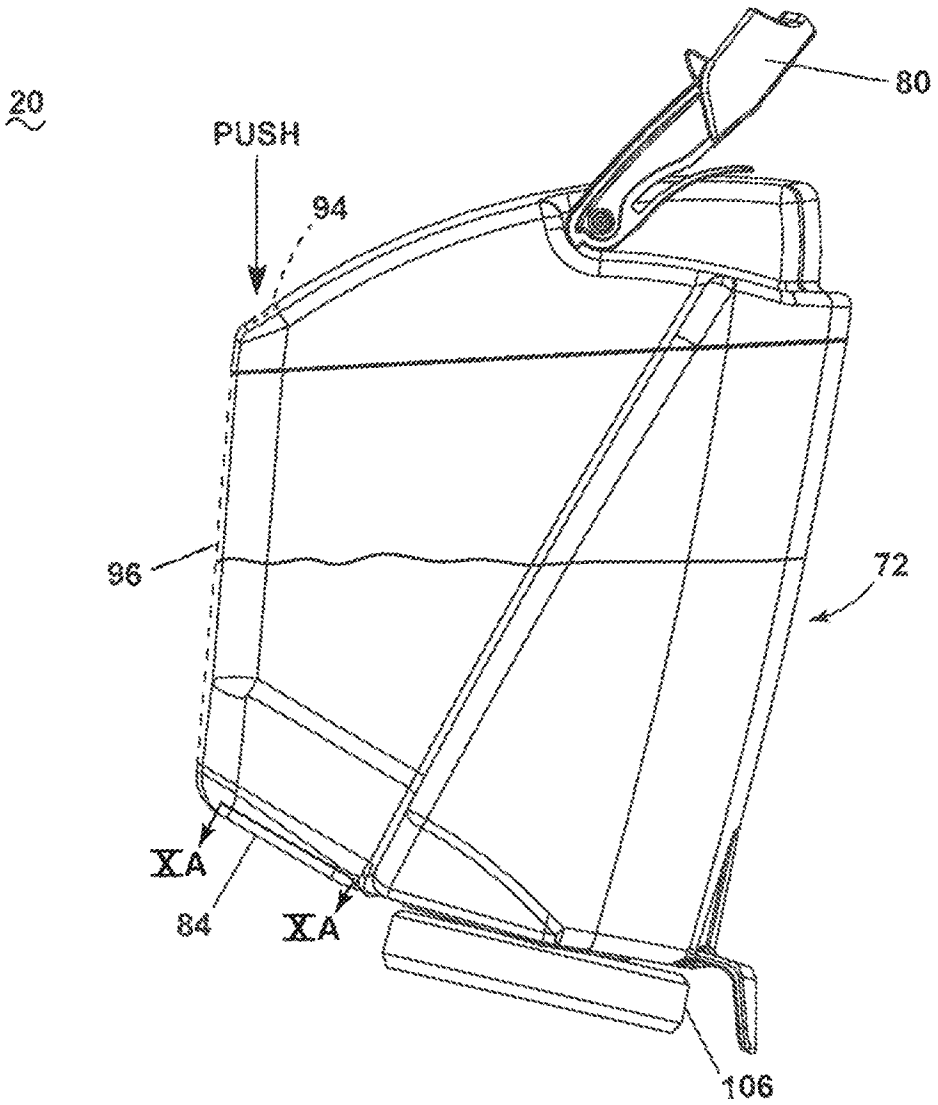
FIG. 8 is a side view of the recovery tank of FIG. 3, illustrating the emptying operation of the tank.
Figure 9:
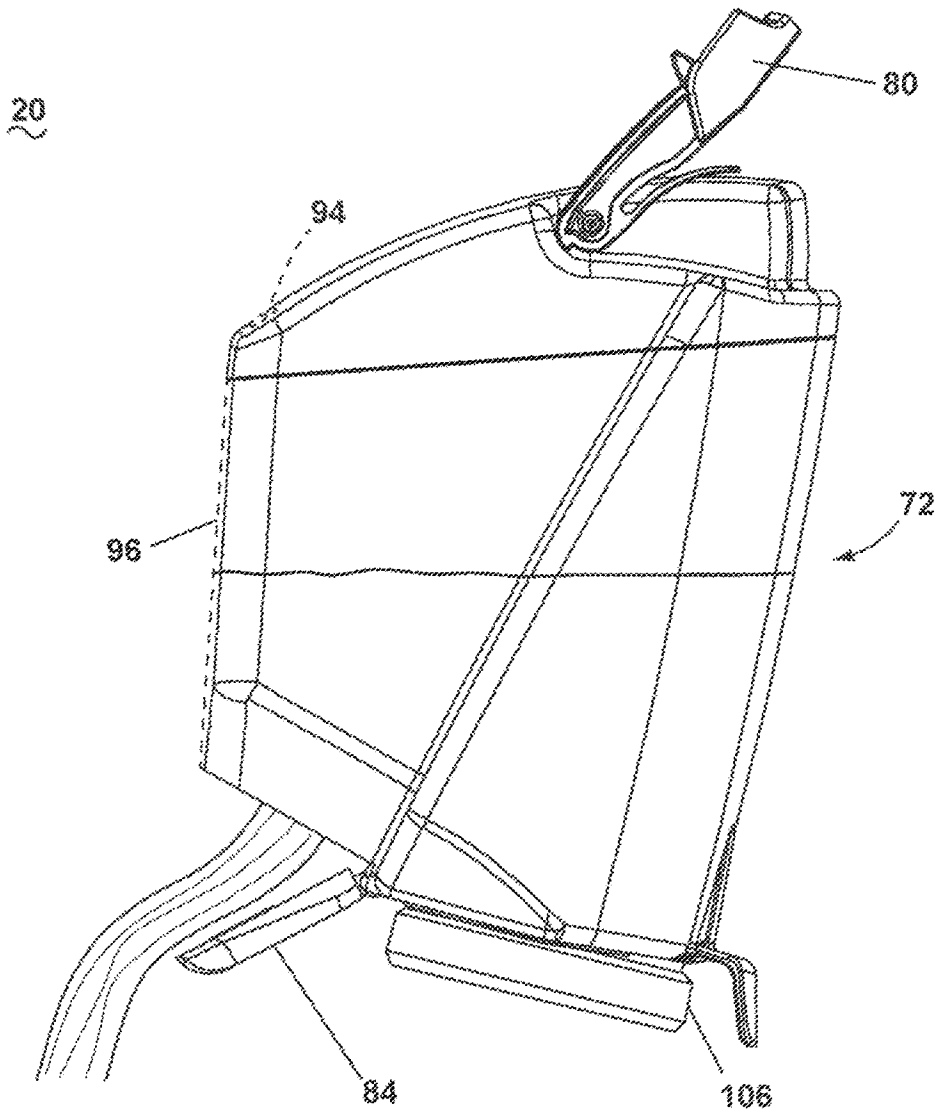
FIG. 9 is a side view of the recovery tank of FIG. 3, illustrating the emptying operation of the tank.

FIGS. 8-9 are side views of the recovery tank 20 of FIG. 3, illustrating the emptying operation of the tank 20. When a user desires to empty the recovery tank 20 of its contents, the user separates the tank 20 from the extraction cleaner 10, carries the tank 20 by its handle 80 to a suitable waste receptacle, such as a sink or toilet, and empties the tank 20 by pushing the button 94 while conveniently maintaining the tank 20 in the same, upright position in which it is carried, as shown in FIG. 8. Pushing the button 94 releases the door latch 98 to open the bottom empty door 84 and separate the drain plug 86 from the drain opening 88, as shown in FIGS. 4 and 9.

It is noted that while the aspect shown in FIGS. 3-9 has the door release mechanism on the outside of the tank 20, at least a portion of the door release mechanism can alternatively be routed inside the tank 20. For example, the push rod 96 and/or the door latch 98 can be provided within the container 72.

Figure 11:
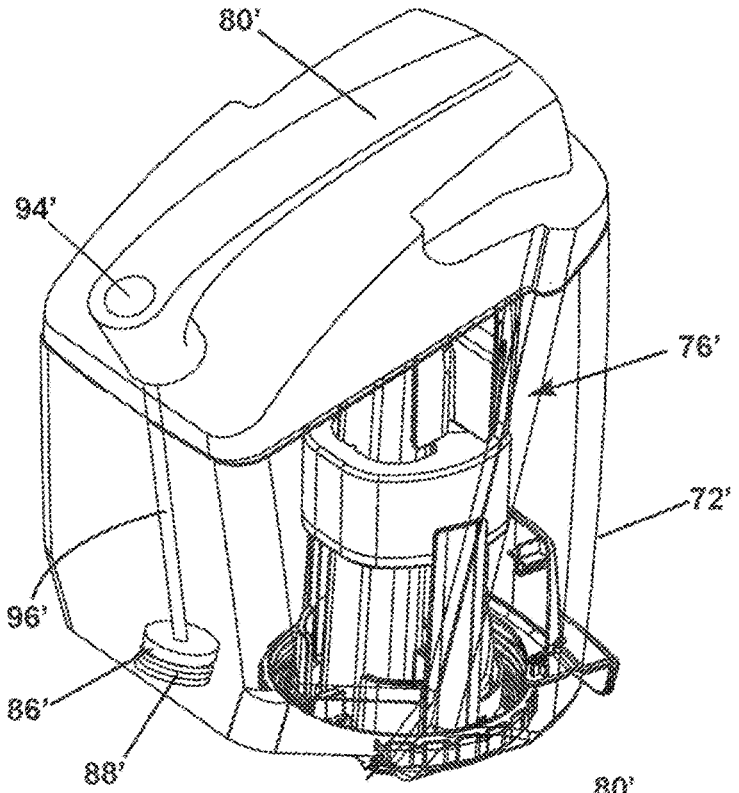
FIG. 11 is a perspective view of a recovery tank for an extraction cleaner according to a second aspect of the present disclosure.

FIG. 11 is a perspective view of a recovery tank 20' for an extraction cleaner according to a second aspect of the present disclosure. The recovery tank 20' may be used on the extraction cleaner 10 shown in FIG. 1 or FIG. 2. In the second aspect, the drain opening 88' is provided on a lower portion and/or at the bottom end of the container 72' and is selectively closed by the drain plug 86', which is connected directly to the push rod 96', rather than being indirectly connected via the door 84 of the first aspect. In one aspect, the drain plug 86' can be connected to the push rod 96' by a fastener (not shown), such as a screw.

The drain plug 86' is aligned with the drain opening 88' to seal the drain opening 88' when the push rod 96' is translated upwardly for a fluid-tight closure, such that the container 72' is leak-free. The drain plug 86' can be at least partially received in the drain opening 88' to stop up or fill the drain opening 88'. Other sealing arrangements are possible, including seals which are not received within the drain opening 88' itself, but which provide a fluid-tight and leak proof engagement between the drain opening 88' and a portion of the push rod 96'.

Also, the push rod 96' can be routed inside the tank 20', which facilitates direct connection to the drain plug 86'. The push rod 96' can be provided within the recovery tank 20; for example, the push rod 96 can be provided for sliding movement within the chamber 74'. The button 94' can be connected to the push rod 96 via a pivot arm (not shown) such that pressing the button 94' downwardly translates the push rod 96' upwardly via the pivot arm (not shown) to pull the drain plug 86' away from the drain opening 88'.

Also in the second aspect, the tank empty button 94' can also be positioned on or adjacent to a portion of the carry handle 80' so that a user can conveniently operate the button 94' when holding the tank 20' by the carry handle 80'.

Yet another difference between the first and second aspects is that in the second aspect, the carry handle 80' is not pivotable or rotatable relative to the container 72'. The carry handle 80' is fixed on the top wall 92; and oriented so that the user can grip the carry handle 80' with one hand and operate the button 94' with the thumb of the same hand. Preferably, the button 94' is provided on the end of the carry handle 80' that is rearward when the recovery tank 20' is mounted on the extraction cleaner 10, such that the user can grip the carry handle 80' to remove the tank 20' and open the drain opening 88' without changing grip position.

When the tank empty button 94' is depressed, the push rod 96' pulls the drain plug 86' away from the drain opening 88' and recovered liquid flows out of the tank 20'. The drain plug 86', push rod 96' and button 94' assembly can be normally biased to the sealed position, so the drain plug 86' seals the drain opening 88'. In one example, a coil spring (not shown) beneath the button 94' can force the button 94' upwardly, which forces the push rod 96' downwardly via the pivot arm (not shown) to the sealed position with the drain plug 86' sealing the drain opening 88'.

Figure 12:
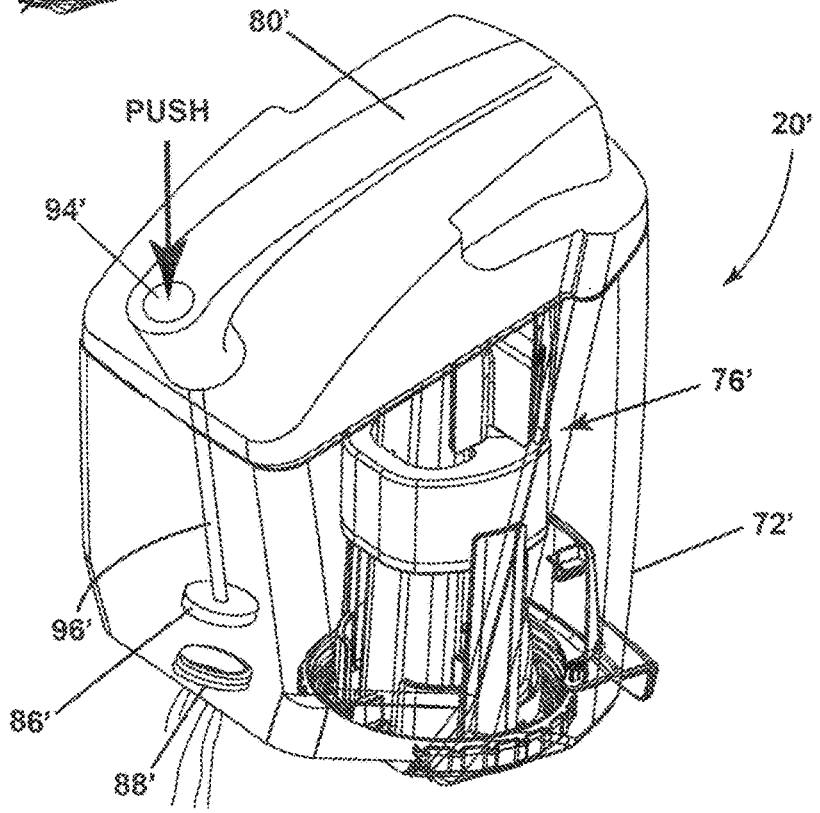
FIG. 12 is a side view of the recovery tank of FIG. 10, illustrating the emptying operation of the tank.

FIG. 12 is a side view of the recovery tank 20' of FIG. 11, the emptying operation of the tank 20'. When a user desires to empty the recovery tank 20' of its contents, the user separates the tank 20' from the extraction cleaner 10, carries the tank 20' by its handle 80' to a suitable waste receptacle, such as a sink or toilet, and empties the tank 20' by pushing the button 94' while conveniently maintaining the tank 20' in the same, upright position in which it is carried, as shown in FIG. 12. Pushing the button 94' pulls the drain plug 86' away from the drain opening 88', and recovered liquid can flow out of the tank 20'.

There are several advantages of the present disclosure arising from the various features of the apparatuses described herein. For example, the aspects of the present disclosure described above allow for quick and ergonomic emptying of a recovery tank for an extraction cleaner. The prior art includes tanks with removable lids or top-emptying features that require the user to tilt or rotate the tank to empty its contents. These actions typically require the use of two hands. The recovery tank 20 shown in the aspects herein offers a more ergonomic push button solution that does not require the tank to be tilted or rotated to empty it. Instead, the tank remains in the upright position and the user can quickly empty the recovered liquid using a single hand with just the push of a button.

While various aspects illustrated herein show an upright extraction cleaner, for example FIG. 2, aspects of the present disclosure may be used on other types of extraction cleaners, including, but not limited to, a canister device having a cleaning implement connected to a wheeled base by a vacuum hose, a portable extractor adapted to be hand carried by a user for cleaning relatively small areas, an autonomous extraction cleaner, or a commercial extractor. For example, any of the aspects can be combined with an extraction cleaner as generally outlined with respect to FIG. 1. Still further, aspects of the present disclosure may also be used on surface cleaning apparatus other than extraction cleaners, such as a steam cleaner or a vacuum cleaner. A steam cleaner generates steam by heating water to boiling for delivery to the surface to be cleaned, either directly or via cleaning pad. Some steam cleaners collect liquid in the pad, or may extract liquid using suction force. A vacuum cleaner typically does not deliver or extract liquid, but rather is used for collecting relatively dry debris (which may include dirt, dust, stains, soil, hair, and other debris) from a surface.

While the present disclosure has been specifically described in connection with certain specific aspects thereof, it is to be understood that this is by way of illustration and not of limitation. Reasonable variation and modification are possible with the scope of the foregoing disclosure and drawings without departing from the spirit of the present disclosure which, is defined in the appended claims. Hence, specific dimensions and other physical characteristics relating to the aspects disclosed herein are not to be considered as limiting, unless the claims expressly state otherwise.

What is claimed is:

1. An extraction cleaner, comprising:

a flexible vacuum hose in fluid communication with a suction inlet;

a suction source in fluid communication with the flexible vacuum hose and the suction inlet for generating a working airstream; and a recovery tank assembly adapted for separating and collecting fluid and debris from the working airstream for later disposal, wherein the recovery tank assembly is removably mounted and comprises:

a recovery container having an upper portion and a lower portion, the recovery container defining at least a portion of a recovery chamber, a drain opening provided with the lower portion;

a valve fluidly connected to the drain opening for movement between a closed position wherein the valve seals the recovery chamber and an opened position wherein the valve allows for draining fluid from the recovery chamber; and an actuator operably coupled to the valve and adapted for moving the valve, wherein at least a portion of the actuator is provided on an upper portion of the recovery container.

2. The extraction cleaner of claim 1, wherein:

the extraction cleaner comprises a portable extractor that is adapted to be hand carried by a user.

3. The extraction cleaner of claim 1, wherein:

the flexible vacuum hose includes an above-the-door cleaning tool at an end of the flexible vacuum hose, wherein the above-the-floor cleaning tool includes an opening forming the suction inlet.

4. The extraction cleaner of claim 1, including:

a suction nozzle configured for on-the-floor cleaning;

a diverter assembly configured to be selectively switched between on-the-floor cleaning and above-the-floor cleaning by diverting fluid communication between either the suction nozzle or the flexible vacuum hose with the suction source.

5. The extraction cleaner of claim 1, including:

a base assembly; and wherein:

the suction inlet is at a first end of the flexible vacuum hose, and wherein a second end of the flexible vacuum hose is coupled to the base.

6. The extraction cleaner of claim 5, wherein:

the suction inlet of the flexible vacuum hose is positionable above the second end of the flexible vacuum hose.

7. The extraction cleaner of claim 5, including:

at least two wheels that are configured to at least partially support the base assembly for movement over a surface.

8. The extraction cleaner of claim 1, including:

a frame having a container receiver that is configured to support the recovery container.

9. The extraction cleaner of claim 8, including:

a releasable retainer that is configured to selectively secure the recovery retainer to the frame.

10. The extraction cleaner of claim 8, wherein:

the frame comprises an upright assembly, the upright assembly having an elongated handle extending upwardly from the frame.

11. The extraction cleaner of claim 1, wherein:

the valve comprises a bottom empty door that is hingedly connected to the recovery container for movement between the closed position in which the bottom empty door covers the drain opening and the opened position in which the bottom empty door is separated from the drain opening.

12. The extraction cleaner of claim 1, wherein:

the actuator comprises:

a push rod configured to selectively move the valve to the opened position; and a user-engageable push button operably connected to the push rod and provided on the upper portion of the recovery container.

13. The extraction cleaner of claim 1, wherein:

the valve comprises a drain plug and the actuator comprises a push rod connected to the drain plug.

14. The extraction cleaner of claim 1, wherein:

the recovery container comprises a bottom wall in which the drain opening is formed, a peripheral side wall extending upwardly from the bottom wall, and a top wall, wherein the actuator comprises a user-engageable button provided on the top wall.

15. An extraction cleaner, comprising:

a support structure;

a suction inlet;

a suction source in fluid communication with the suction inlet for generating a working airstream; and a recovery tank assembly adapted for separating and collecting fluid and debris from the working airstream for later disposal, wherein the recovery tank assembly is removably mounted to the support structure and comprises:

a recovery container having an upper portion and a lower portion, the recovery container defining at least a portion of a recovery chamber, a drain opening provided with the lower portion;

a valve fluidly connected to the drain opening for movement between a closed position wherein the valve seals the recovery chamber and an opened position wherein the valve allows for draining fluid from the recovery chamber; and an actuator operably coupled to the valve and adapted for moving the valve, wherein at least a portion of the actuator is provided on an upper portion of the recovery container, whereby a user can separate the recovery tank assembly from the support structure and position the drain opening of the recovery tank assembly over a waste receptacle, followed by actuation of the actuator to move the valve from the closed position to the open position to empty the recovery chamber while maintaining the recovery tank assembly in an upright position.

16. The extraction cleaner of claim 15, including:

a handle on an upper portion of the recovery tank assembly.

17. The extraction cleaner of claim 15, including:

a flexible hose fluidly connecting the suction inlet to the suction source.

18. The extraction cleaner of claim 15, including:

a suction nozzle configured for on-the-floor cleaning;

a diverter assembly configured to be selectively switched between on-the-floor cleaning and above-the-floor cleaning by diverting fluid communication between either the suction nozzle or the flexible vacuum hose with the suction source.

19. A method of emptying liquid from a recovery container of a recovery tank assembly of an extraction cleaner having a fluid delivery system and a fluid system, the method comprising:

separating the recovery tank assembly from a support structure of the extraction cleaner;

followed by carrying the recovery tank assembly to a waste receptacle;

positioning at least a portion of the recovery tank assembly over the waste receptacle;

causing liquid to flow out of the recovery container into the waste receptacle by opening a valve on a lower side of the recovery tank assembly while maintaining the recovery tank assembly in an upright position.

20. The method of claim 19, wherein:

the recovery tank assembly includes an actuator on an upper portion of the recovery container that is operably coupled to the valve;

opening the valve includes actuating the actuator while at least a portion of the recovery tank assembly is positioned over the waste receptacle.

* * * * *